US006488577B1

(12) United States Patent
Nakajima et al.

(10) Patent No.: US 6,488,577 B1
(45) Date of Patent: Dec. 3, 2002

(54) COIN PAYOUT DEVICE

(75) Inventors: Kenji Nakajima, Saitama (JP); Takahiro Hayashi, Kitamoto (JP); Mitsugu Mikami, Kawagoe (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 296 days.

(21) Appl. No.: 09/670,092

(22) Filed: Sep. 26, 2000

(30) Foreign Application Priority Data

Sep. 29, 1999 (JP) ..... 11-276503

(51) Int. Cl.[7] ..... G07D 1/00
(52) U.S. Cl. ..... 453/44
(58) Field of Search ..... 453/44, 43, 39, 453/63

(56) References Cited

U.S. PATENT DOCUMENTS 2,532,084 A * 11/1950 Burasco ..... 221/264
2,899,039 A * 8/1959 Erickson ..... 194/225
4,792,057 A * 12/1988 Mizer et al. ..... 221/187
4,834,689 A * 5/1989 Levasseur ..... 453/21
5,330,384 A * 7/1994 Shapley et al. ..... 221/123
5,645,477 A * 7/1997 Satoh et al. ..... 453/40
5,679,070 A * 10/1997 Ishida et al. ..... 194/200

FOREIGN PATENT DOCUMENTS

DE 3641346 A1 * 6/1988 ..... G07F/9/04
JP 58-90462 12/1981
JP 64-42787 8/1987
JP 3/52095 A * 3/1991 ..... G07D/1/00
JP 07152939 A 11/1993
JP 07160920 A 6/1995

* cited by examiner

*Primary Examiner*—Donald P. Walsh
*Assistant Examiner*—Mark J Beauchaine
(74) *Attorney, Agent, or Firm*—Welsh & Katz, Ltd.

(57) ABSTRACT

In a coin payout device, a coin supporting member (22) made of a resilient material is provided such that, when the payout slide (30) moves into the coin payout position, the coin supporting member (22) projects into the bottom face of a coin tube (10) and supports the bottom face of the coins (C) remaining within the coin tube (10)

9 Claims, 7 Drawing Sheets

COIN PAYOUT DEVICE

BACKGROUND OF THE INVENTION

1. Field of the Invention

This invention relates to an improvement of a coin payout device which pays out coins which are stacked in a coin tube one after another.

2. Description of the Related Art

Generally, inside devices such as automatic vending machines a coin processing device is provided which determines whether inserted coins are genuine, stores the coins separately by denomination and pays out coins in response to requests for change.

This coin processing device comprises a coin sorting device which determines whether the inserted coins are genuine, differentiates the coins according to their denominations and removes the coins which are not genuine; a coin holding device which comprises plurality of coin tubes which respectively store coins according to their denominations selected by the coin sorting device in a stacked condition; and a coin payout device which pays out coins in response to the a request for change from each coin tube of the coin holding device.

FIG. 7 is a sectional diagram showing the principal part of a conventional coin payout device 1.

This conventional coin payout device 1 comprises a payout slide 5 in which there is formed a coin holding hole 4 which holds a single coin 3 that is positioned on the lowermost part of a plurality of stacked coins A held inside a coin tube 2 which is the main structural element of the coin storage device.

This payout slide 5 is constituted so that it is inserted with play into a coin payout slit 7 formed between the coin tube 2 and a coin base 6 which is fixed to the bottom of this coin tube 2 and moves in a reciprocating fashion in the direction of the indicating arrow B by means of the generally known drive means composed of a motor and link and the like not shown in the figures.

In a coin payout device 1 with a constitution of this type, as shown in FIG. 8, when the payout slide 5 moves in the direction of an arrow B by means of a drive device (not shown in the figure) and the inner circumferential face of the coin holding hole 4 is moved away from the outer circumference 6a of the coin base 6, the single coin 3 which is held inside the coin holding hole 4 drops down under its own weight and is paid out.

At this time, the bottom face of the plurality of coins A remaining in the coin tube 2 is supported by the coin support face 5*a* formed on the edge of the payout slide 5 in such a way that the attitude of the stack of the coins A is not changed inside the coin tube 2.

On the other hand, the width of the coin payout device 1 is specified as a prescribed value W as shown in FIG. 7 so that it can be installed on the same plane inside the coin processing device not shown in the figures.

For this reason, as shown in FIG. 9, the length S2 of the coin support face 5*b* formed on the part of the payout slide 5 facing, among the plurality of coin tubes, the coin tube 10 holding the stacked larger diameter coins C (the diameter of coin A is smaller than the diameter of coin C) has to be made short (S2<S1) in comparison with the length S1 of the coin support face 5*a* of the smaller diameter coins A (shown in FIG. 7) because the coin holding hole 11 holding the larger diameter coins C is formed in the payout slide 5.

Meanwhile, as shown in FIG. 9, if the length S2 of the coin support face 5*b* facing the coin tube 10 holding the stacked larger diameter coins C (the diameter of coin A is smaller than the diameter coin diameter C) is shorter than the length S1 (S2<S1), and, as shown in FIG. 10, the payout slide 5 is extended in the direction of the arrow B, then as a result of this when the larger diameter coin 12 held inside the coin holding hole 11 is paid out, the lowermost one of the larger diameter coins C remaining inside the coin tube 10 is supported on the coin support face 5*b* with the shorter length S2.

Then the problem arises that, since only a small part of the larger diameter coin C is supported on the shorter coin support face 5*b*, the supporting state of coin C becomes unstable and the larger diameter coin C remaining inside the coin tube 10 can easily assume an inclined attitude. When the payout slide 5 returns to the initial position shown in FIG. 9 with the larger diameter coin C left in such an inclined attitude, the load applied to the payout slide 5 increases as a result of the collision between the respective payout slide 5 and the coin C in the inclined attitude and for this reason the payout slide 5 is easily subject to wear and damage. Furthermore, when there is a small number of coins C held inside the coin tube 10, the coin C rattles around inside the coin tube 10 due to the collision with the payout slide 5, and for this reason the coin C to be paid out is not held inside the coin holding hole 11 and the coin C cannot be paid out.

In order to overcome these problems, as shown in FIG. 11, it is possible to increase the length S3 (S3>S2) of the coin support face 5*b* of the payout slide 5, but if this is done, as shown in FIG. 12, when the payout slide 5 returns to the initial position, the coin support face 5*b* projects to a large extent from the front face 10*a* of the coin tube 10 and for that reason the problem arises that the width WI of the coin payout device 1 at the coin support face 5*b* of the payout slide 5 becomes larger than the width W of the part of the coin tube 2 shown in FIG. 7, (W1>W) and not only is there enlargement but also it becomes impossible to install the coin payout device 1 on the same plane inside the coin processing device.

On the other hand, in order to overcome this type of problem, Japanese Laid-Open Utility Model Application H2-99465 shows typically in FIG. 10 that a block with an L-shaped tip is arranged on the rear face of the coin tube, and in the initial position of the payout slide the tip of that block moves away from the bottom of that coin tube, and when the coin is paid out the tip of that block is made to project into the bottom of the coin tube so that the lowermost coin in the coin tube is supported thereby.

However, in the invention disclosed in this Japanese Laid-Open Utility Model Application H2-99465, the edge of the payout slide comprising a plate is made to collide directly with the tip of the block which also comprises a plate and the respective block is constituted so that it moves away from the bottom of the coin tube, and therefore if that collision is repeated many times over a lengthy period, the projecting edge of the payout slide and the edge of the block each easily become deformed and damaged and especially if the projecting tip of the block comprising a plate is damaged and becomes deformed, the edge of the payout slide and the tip of the block do not collide against one another and for this reason a state is brought about in which the block remains projecting into the bottom of the coin tube and the there is a risk that it will not be possible to pay out the coin from inside the coin tube.

In addition, in the invention disclosed in this Japanese Laid-Open Utility Model Application H2-99465, there is the problem that because the edge of the payout slide is constituted so that it projects directly into the edge of the block and the respective block is made to move away from the bottom of the coin tube, when the respective block moves away from the bottom of the coin tube, the degree to which the rear edge of the plate projects from the side face of the coin tube becomes greater, and for this reason the width W of the coin payout device becomes large.

SUMMARY OF THE INVENTION

With the foregoing in view it is an object of the present invention to provide a coin payout device which is small in size and is not easily damaged but can pay out coins in a stable fashion.

In order to overcome the abovementioned problem, this invention provides a coin payout device comprising a coin tube for storing stacked coins; a payout slide arranged on bottom of the coin tube so as to be capable of moving in a reciprocating fashion and formed with a coin holding hole, for holding, in a coin storage position, a lowermost coin of the coins stacked in the coin tube in the coin holding hole and for paying out the lowermost coin in the coin holding hole by moving the lowermost coin to a coin payout position; and a coin support means made of a resilient material and arranged in such a way that one end is pivotably supported on a side wall of the coin tube and another end is positioned in a lowermost part of the coin tube, the coin support means including an engagement portion formed so as to project from a part of the another end and a coin support component for supporting the lowermost coin, the coin support component being formed at another part of the another end so as to be bent into an L shape at an inner side from a tip end of the engagement portion and to project into an opening in the lowermost part of the coin tube, wherein a gap is provided between at least a part of the payout slide and the lowermost part of coin tube, the coin support component of the coin support means being able to move into the gap, whereby when the payout slide is in the coin storage position, the coin payout slide pushes out the engagement portion so that the coin support component is moved away from the bottom opening of the coin tube and when the payout slide is in the coin payout position, the coin support component is made to project into the bottom opening of the coin tube.

DESCRIPTION OF THE PREFERRED EMBODIMENTS

An embodiment of the coin payout device according to the present invention is shown below in detail.

Figure 1:
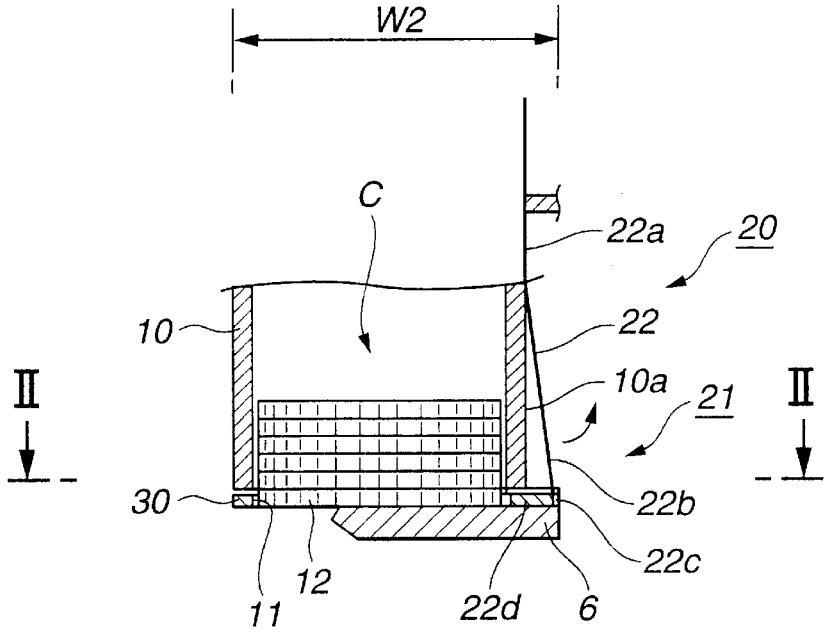
FIG. 1 is a schematic diagram showing the main elements of the coin payout device according to the present invention.

FIG. 1 is a sectional diagram showing the principal part of the coin payout device 20 according to the present invention using the same reference numerals and letters as in FIG. 1 for the same components.

In this coin payout device 20, a coin support element 21 is arranged in the front face of each coin tube. As shown in FIG. 1, a coin support element 21 is arranged in the front face 10*a* of the coin tube 10 which holds the stacked larger diameter coins C (the diameter of coin A < the diameter of coin C).

In the coin payout device 20, even in the coin tube 10 which holds the larger diameter coin C, the width of the payout coin device 20 is specified as a prescribed value W2 (W2<W<W1).

The coin support element 21 is formed from a coin support means 22 made of a metal plate having resiliency, in which its upper edge 22*a* is pivotably installed, by means of fixing means such as screws or the like (not shown in the figures) to the outer surface of the front face 10*a* of the coin tube 10.

The coin support means 22 may be constituted by a plate made of ceramic or synthetic resin having resiliency.

Figure 2:
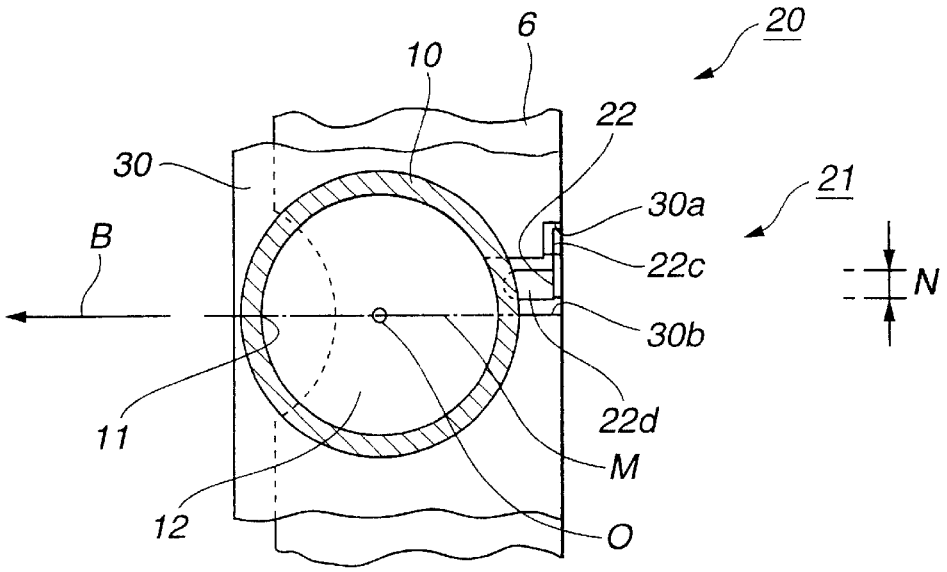
FIG. 2 is a diagram of the cross section of II—II in FIG. 1.
Figure 3:
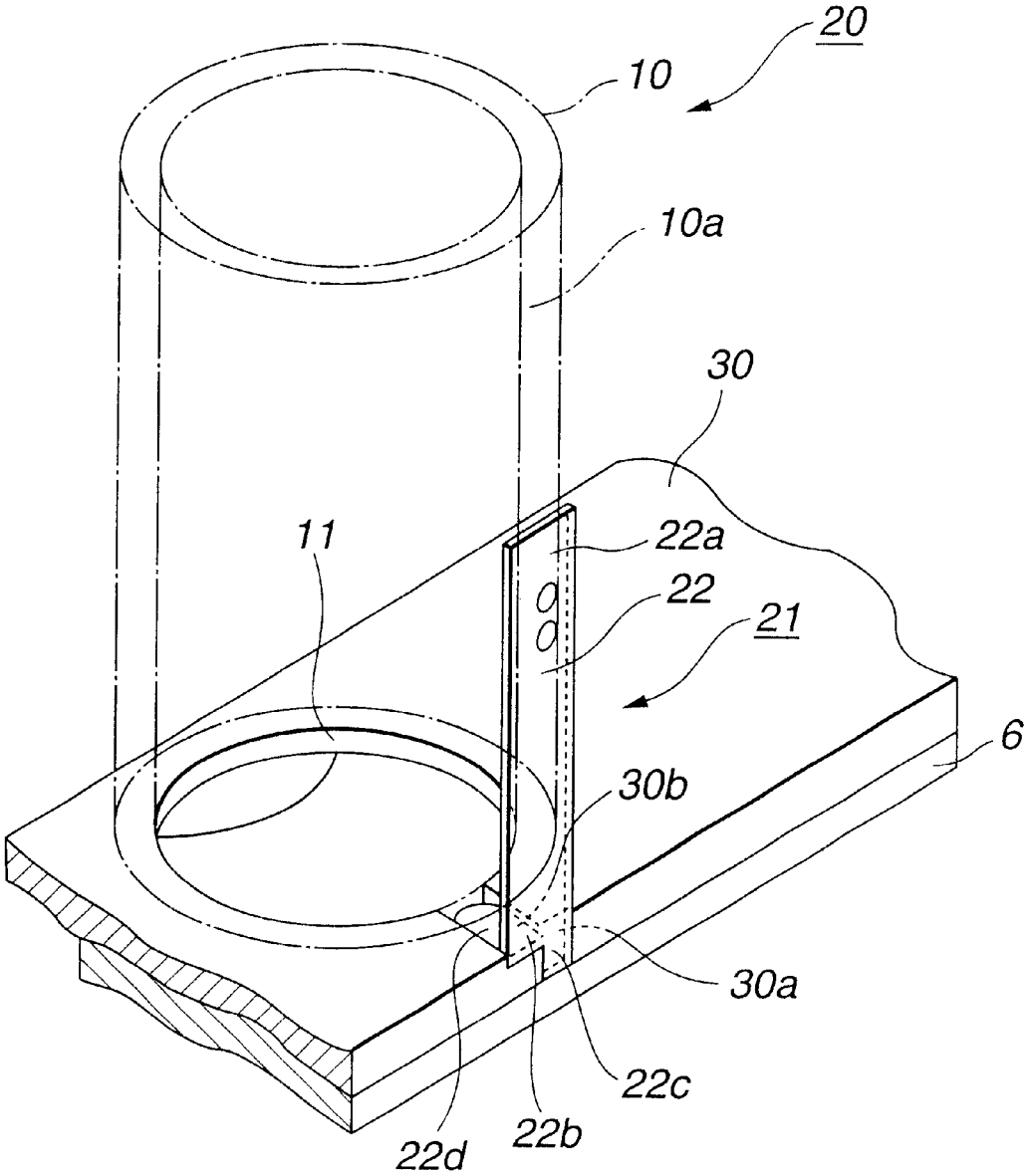
FIG. 3 is a schematic diagram showing a perspective view of FIG. 1.

In the lower edge 22*b* of the coin support means 22, as shown in FIG. 2 which shows the cross section of II—II in FIG. 1 and FIG. 3 which shows a perspective view of FIG. 1, a linear engagement portion 22*c* which engages in a notch 30*a* formed in the edge of the payout slide 30 and a coin support component 22*d* which is folded into the L form pointing in the direction of the coin tube 10 are formed adjacent to one another. The edge of the coin support component 22*d* is in the form of a circular arc and provided on the upper face of the payout slide 30. The underside of the coin support component 22*d* is inserted with play into a concave component 30*b* which is bent into a concave state.

As shown in FIG. 2, the coin support means 22 and the coin support component 22*d* are arranged in a deviated position by a distance N with respect to a straight line M running through the center 0 of the coin tube 10 in the direction of the movement of the payout slide 30.

Next, the operation of the coin support element 21 will be explained.

Referring to FIG. 1, in an initial position of the payout slide 30 in which a coin 12, which is positioned on the bottom of the stacked large diameter coins C held in the interior of the coin tube 10, is held inside a coin holding hole 11, the engagement portion 22*c* of the coin support means 22 forming the coin support element 21 engages with a notch 30*a* (FIG. 3) of the payout slide 30 and is coupled to it.

In this situation, in the initial position of the payout slide 30, by the force from the payout slide 30 which makes the slide movement, the coin support means 22 which couples to the notch 30*a* is bent in the counterclockwise direction as shown in FIG. 1, which in turn the coin support component 22*d* is moved out from the bottom of the interior of the coin tube 10. Thus, a state is maintained in which, of the large diameter coins C held inside the coin tube 10, only the coin 12 positioned on its bottom is held smoothly inside the coin holding hole 11.

As shown in FIGS. 2 and 3, in the coin payout device 20, the linear engagement portion 22*c* of the coin support means 22 and the notch 30*a* formed in the edge of the payout slide 30 are coupled to each other to cause the coin support component 22*d* of the coin support means 22 to move away from the bottom inside of the coin tube 10. Further, as shown in FIG. 2, the coin support means 22 and the coin support component 22*d* are deviated by the distance N with respect to the straight line passing through the center of the coin tube 10, and the end of the coin support component 22*d* is formed into a circular arc as mentioned above. Therefore, compared to the conventional device (as disclosed in Japanese Laid-Open Utility Model Application H2-99465) in which the ends of the payout slide and of the block are made to abut directly against each other, the degree by which the coin support component 22d of the coin support means 22 projects from the one side face (front face 10*a*) of the coin tube 10 is smaller and for this reason the width W2 of the coin payout device can be further decreased.

In addition, in the conventional device disclosed in this Japanese Utility Model Laid-Open Application H2-99465, the edge of the payout slide and the tip of the block are not made to abut directly and as a result of the fact that the engagement portion 22*c* in the state in which it is in a straight line formed by touching the coin support component 22*d* and the notch 30*a* formed in the edge of the payout slide 30, in other words in the edge of the payout slide 30 in the embodiment are coupled to one another, because the coin support component 22*d* of the coin support means 22 is made to move away from the bottom inside the coin tube 10, this coin support component 22*d* does not directly abut the payout slide 30, and consequently the coin support component 22*d* and the payout slide 30 cannot be damaged or deformed.

To paid out the coin 12 held inside the coin holding hole 11, the payout slide 30 is moved from its initial position in the direction of the arrow B as shown in FIG. 2. Then, the inner circumferential surface of the coin holding hole 11 moves away from the outer circumferential edge 6*a* of the coin base 6, which causes the single larger diameter coin 12 held inside the coin holding hole 11 to drop down in the downward direction and is paid out, as shown in FIG. 4 and its section V—V shown in FIG. 5 and also in FIG. 6 which shows a perspective general view of FIG. 4.

Figure 4:
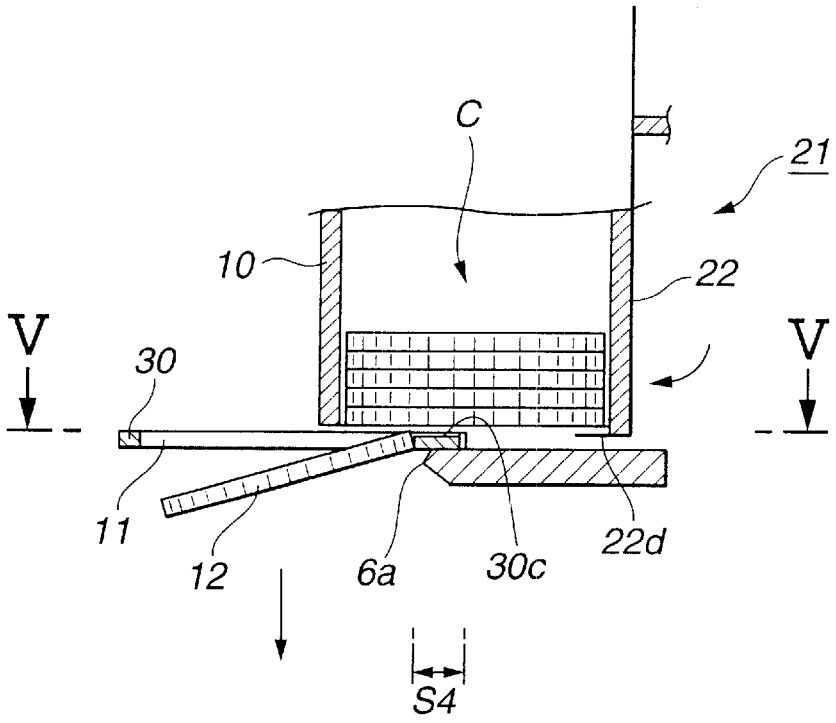
FIG. 4 is a schematic sectional diagram showing the coin payout state of the payout device according to the invention.
Figure 5:
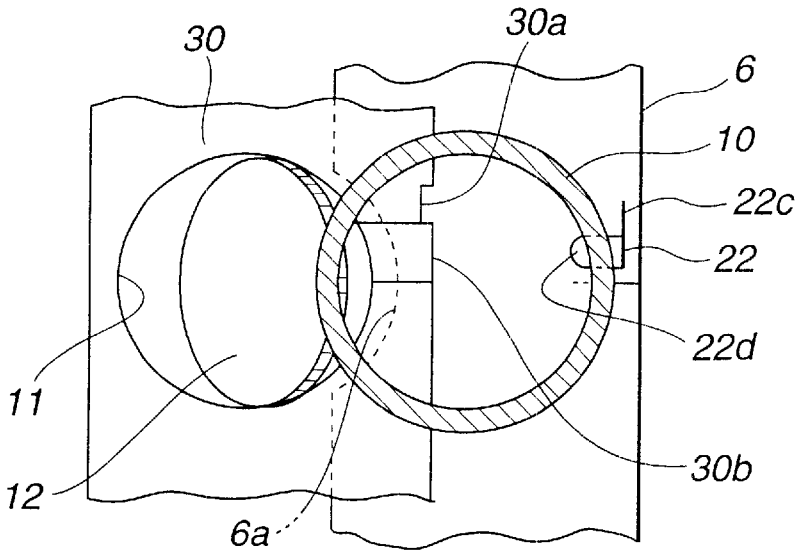
FIG. 5 is a cross section of V—V in FIG. 4.

In this way, when the payout slide 30 moves from the initial position shown in FIG. 2 to the payout position shown in FIG. 4, the coupling of the engagement portion 22*c* which forms the coin support means 22 of the coin support element 21 shown in FIG. 2 and the notch 30a of the payout slide 30 is cancelled and as a result of this, due to its inherent resilience, the coin support means 22 causes the tip fixed to the pivot point to rotate as shown in FIG. 4, as a result makes the coin support component 22*d* of the coin support means 22 penetrate the bottom of the interior of the coin tube 10, and its upper face supports the bottom of the larger diameter coin C remaining inside the coin tube 10.

Figure 6:
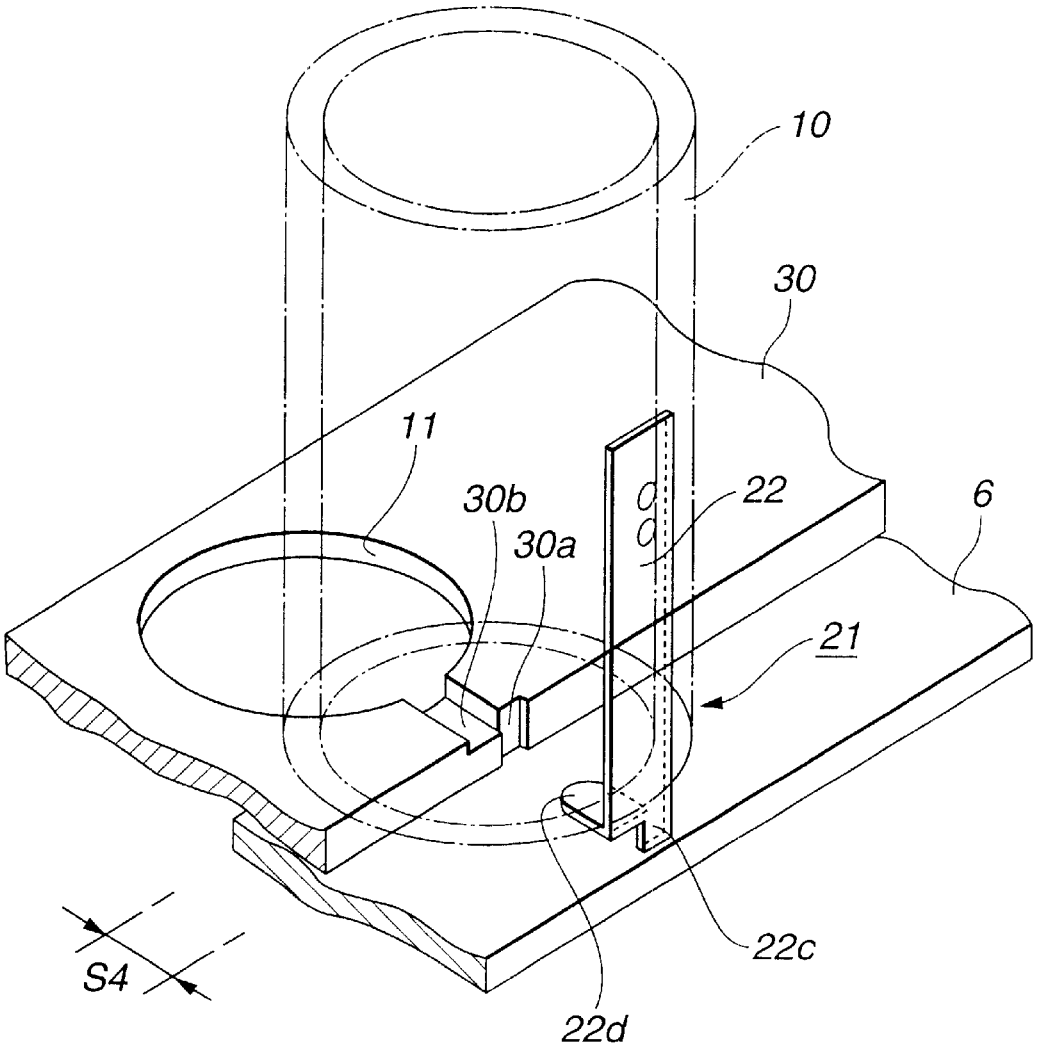
FIG. 6 is a schematic diagram showing a perspective view of FIG. 4.
Figure 7:
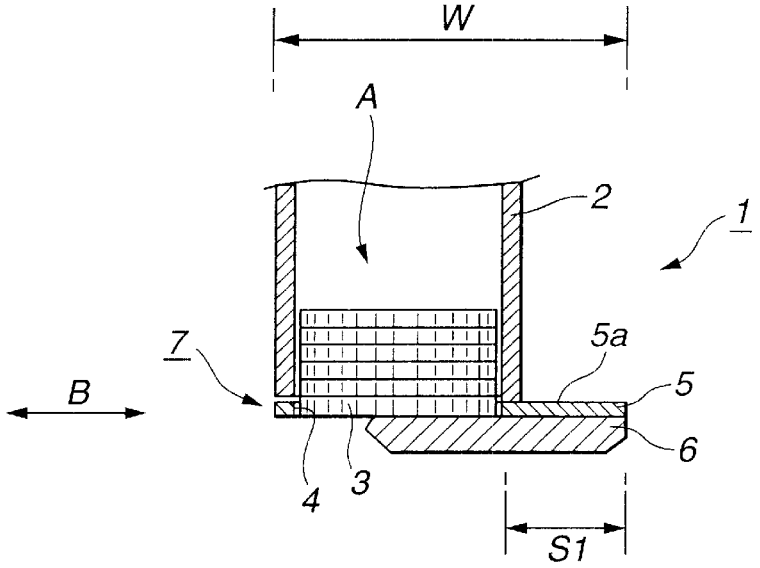
FIG.7 PRIOR ART
FIG. 7 is a schematic diagram showing a sectional view of the main elements of a conventional coin payout device.
Figure 8:
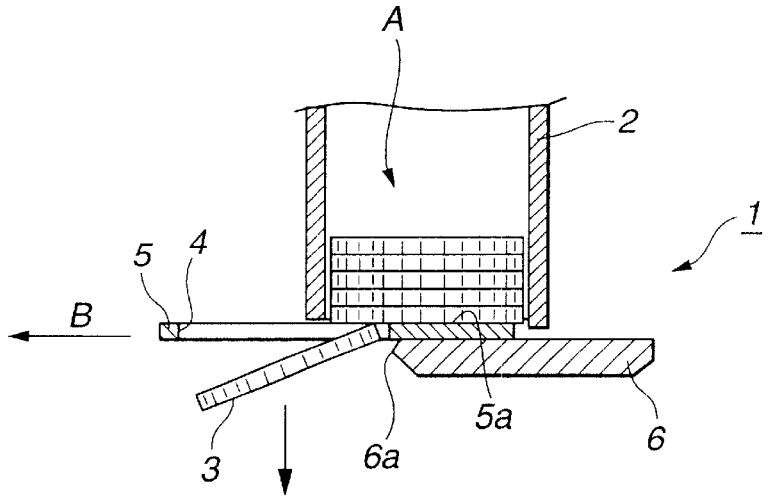
FIG.8 PRIOR ART
FIG. 8 is a schematic sectional diagram showing the coin payout state of the conventional coin payout device.
Figure 9:
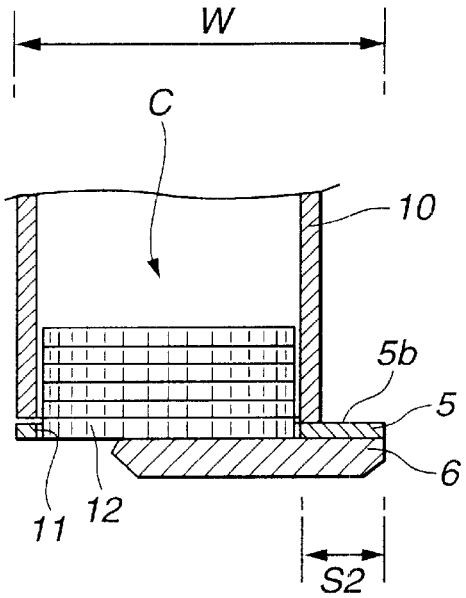
FIG.9 PRIOR ART
FIG. 9 is a schematic diagram showing a sectional view of the main elements of the conventional coin payout device.
Figure 10:
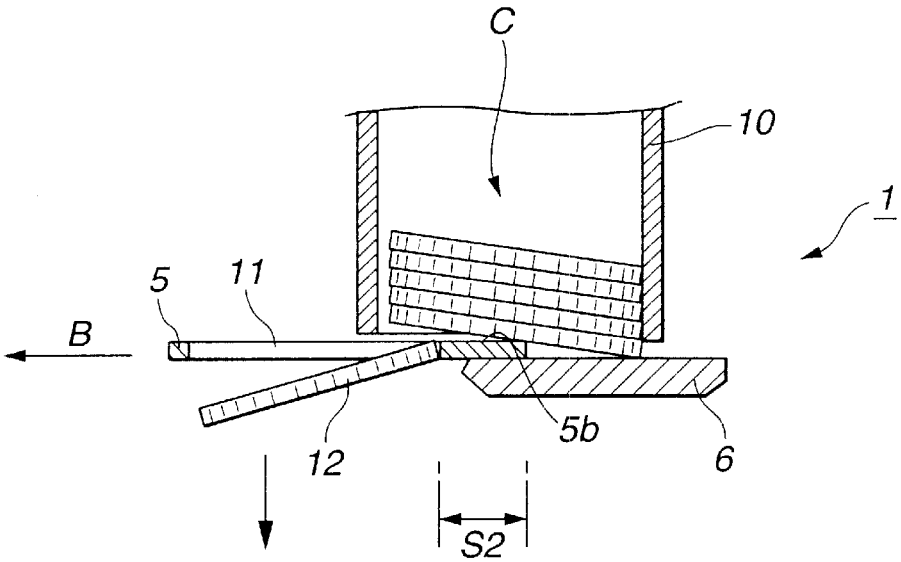
FIG.10 PRIOR ART
FIG. 10 is a schematic diagram showing a sectional view of the conventional coin payout device.
Figure 11:
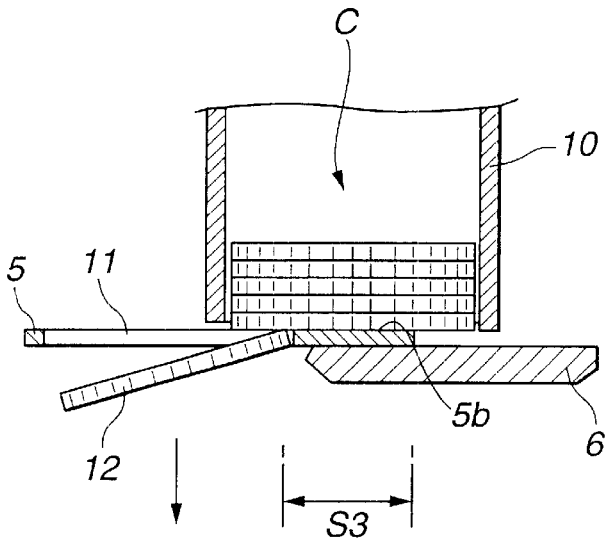
FIG.11 PRIOR ART
FIG. 11 is a schematic sectional diagram showing the coin payout state of the conventional coin payout device.
Figure 12:
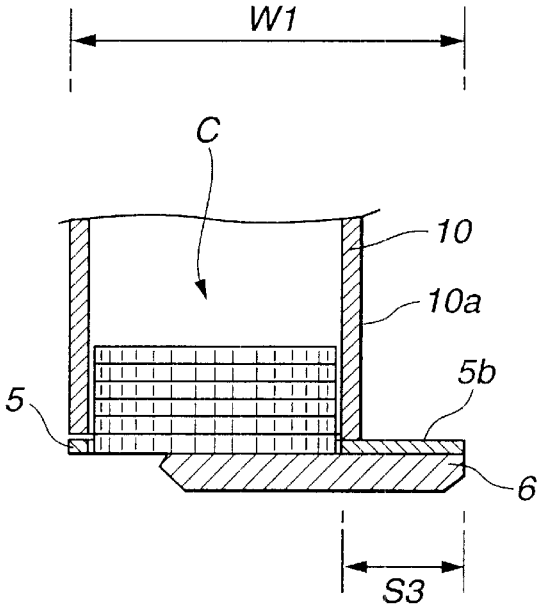
FIG.12 PRIOR ART
FIG. 12 is a schematic sectional diagram showing the main elements in the conventional coin payout device.

Therefore, as shown in FIGS. 4 and 6, even if the length S4 of a coin support face 30*c* of the payout slide 30 is set extremely short, the larger diameter coin C remaining inside the coin tube 10 does not assume an inclined attitude and a horizontal attitude is maintained.

In this way, both ends of the larger diameter coins C remaining inside the coin tube 10 are supported by the coin support component 22*d* of the coin support element 21 and the coin support face 30*c* of the payout slide 30, and the coins C are maintained in a horizontal attitude so that when the payout slide 30 returns to the initial position as shown in FIG. 1, the payout slide 30 and the coins C do not collide and therefore the wear and damage of the payout slide 30 can be prevented as much as possible.

In addition, because the payout slide 30 and the coins C do not collide, when a small number of coins C are held inside the coin tube 10 the coins are prevented from rattling around as far as possible and for this reason it becomes possible to hold the coins C inside the coin holding hole 11 stably.

Furthermore, because one edge of the coin C is supported by the coin support component 22*d* of the coin support element 21, it is possible for the length .S4 of the coin support face 30*c* of the payout slide 30 shown in FIG. 4 to be set short and for this reason the extremely short prescribed value W2 can be 'specified for the width of the coin payout device 20, as shown in FIG. 1, and for this reason the coin payout device 20 can be prevented from becoming large in size and the coin payout device can be installed on one plane inside a coin processing device.

When the payout slide 30 returns to the initial position shown in FIG. 1, as mentioned above the coin support means 22 which couples with the notch 30*a* in the payout slide 30 is bent in a counterclockwise direction and for this reason the coin support component 22*d* moves away from the bottom inside the coin tube 10 and, from among the larger diameter coins C held inside the coin tube 10, the coin 12 positioned on the next lowermost position in the coin tube 10 is held inside the coin holding hole 11.

In the embodiment, details have been given with respect to the case in which a coin support element 21 is arranged in the coin tube 10 which holds the larger diameter coins C, but this invention is not limited to the embodiment above and it is also possible to apply a coin support element 21 to a different type of coin tube which hold coins with a diameter which differs from that of the coins C.

In the embodiment above a notch 30*a* is formed in the end part of the payout slide 30 in the position facing to the engagement portion 22*c* of the coin support means 22 and the notch 30*a* is coupled to the engagement portion 22*c*. However, such a notch 30*a* does not necessarily have to be provided, and the end part of the payout slide 30 may simply be coupled to the engagement portion 22*c*.

Further, the portion of the payout slide 30 to which the engagement portion 22*c* is coupled is necessarily the end part thereof, but it may be constructed so that other portion of the payout slide 30 is connected to the engagement portion. For example, it may be so constructed that a protrusion is provided at the payout slide 30 and the protrusion is coupled to the engagement portion 22*c*.

Furthermore, a concave part 30*b* into which a coin support component 22*d* of the coin support means 22 is inserted with play is formed at the upper face of the payout slide 30, but it is possible to omit the concave part 30*b* if there is a space into which the coin support component 22*d* of the coin support, means 22 is inserted with play, between the bottom of the coin tube 10 and the upper face of the payout slide 30.

As explained above, in the coin payout device according to this invention, the engagement portion of the coin support means and the payout slide are coupled to each other so that the coin support component is thereby moved away from the bottom inside the coin tube. Therefore, in contrast to the case in which the tip end of the payout slide and the tip end of the coin support component are made to directly abut against each other, damage to the coin: support component and to the payout slide can be prevented as far as possible and as a result of this it is possible to provide a coin payout device which operates reliably over a long period.

In addition, because the engagement portion of the coin support means and the payout slide are coupled to each other to cause the coin support component of the coin support means to move away from the bottom inside the coin tube 10, in comparison to the case in which the tip end of the payout slide and the tip end of the coin support component are made to directly abut against each other, the degree by which the coin support component of the coin support projects from the one side face of the coin tube 10 becomes smaller, and for this reason it is also possible to make the width of the coin payout device smaller and to provide a coin payout device whose size is even more smaller, This invention may be embodied in various other forms without departing from its spirit or main characteristics. For this reason, the abovementioned embodiments, in all their various points, are merely intended for indicative purposes and are not to be interpreted as having limiting force. The scope of the present invention is defined by means of patent claims and is not restricted in any way to the text of the specification. Furthermore, changes and amendments having equivalence in scope to the scope of the patent claims lie entirely within the scope of the present invention.

What is claimed is:

1. A coin payout device comprising:

a coin tube for storing stacked coins;

a payout slide arranged on bottom of the coin tube so as to be capable of moving in a reciprocating fashion and formed with a coin holding hole, for holding, in a coin storage position, a lowermost coin of the coins stacked in the coin tube in the coin holding hole and for paying out the lowermost coin in the coin holding hole by moving the lowermost coin to a coin payout position; and a coin support means made of a resilient material and arranged in such a way that one end is pivotably supported on a side wall of the coin tube and another end is positioned in a lowermost part of the coin tube, the coin support means including an engagement portion formed so as to project from a part of the another end and a coin support component for supporting the lowermost coin, the coin support component being formed at another part of the another end so as to be bent into an L shape at an inner side from a tip end of the engagement portion and to project into an opening in the lowermost part of the coin tube, wherein a gap is provided between at least a part of the payout slide and the lowermost part of coin tube, the coin support component of the coin support means being able to move into the gap, whereby when the payout slide is in the coin storage position, the coin payout slide pushes out the engagement portion so that the coin support component is moved away from the bottom opening of the coin tube and when the payout slide is in the coin payout position, the coin support component is made to project into the bottom opening of the coin tube.

2. The coin payout device as claimed in claim 1, wherein the coin support means is composed of a resilient metal material.

3. The coin payout device as claimed in claim 1, wherein the coin support component is shaped into a circular arc at a tip end thereof.

4. The coin payout device as claimed in claim 1, wherein there is formed a concave part in at least a part of the payout slide so that the coin support component of the coin support means can move into the concave part.

5. The coin payout device as claimed in claim 1, wherein the coin support means is pivotably supported on a sidewall of the coin tube at a position deviated from center of the coin tube with respect to the coin payout direction.

6. A coin payout device comprising:

a coin tube for storing stacked coins;

a payout slide arranged on bottom of the coin tube so as to be capable of moving in a reciprocating fashion and formed with a coin holding hole, for holding, in a coin storage position, a lowermost coin of the coins stacked in the coin tube in the coin holding hole and for paying out the lowermost coin in the coin holding hole by moving the lowermost coin to a coin payout position; and a coin support means made of a resilient material and arranged in such a way that one end is pivotably supported on a side wall of the coin tube and another end is positioned in a lowermost part of the coin tube, the coin support means including an engagement portion formed so as to project from a part of the another end and a coin support component for supporting the lowermost coin, the coin support component being formed at another part of the another end so as to be bent into an L shape at an inner side from tip end of the engagement portion and to project into an opening in the lowermost part of the coin tube, wherein the payout slide includes a notch formed such that the engagement portion of the coin supporting means is coupled with the notch at an inner position from a tip end of an end portion thereof corresponding to the coin supporting means, and a concave part formed adjacent to the notch such that the coin supporting component of the coin supporting means can move into the concave part, whereby when the payout slide is in the coin storage position, the notch pushes out the engagement portion so that the coin support component is moved away from the bottom opening of the coin tube and when the payout slide is in the coin payout position, the coin support component is made to project into the bottom opening of the coin tube.

7. The coin payout device as claimed in claim 6, wherein the coin support means is composed of a resilient metal material.

8. The coin payout device as claimed in claim 6, wherein the coin support, component is shaped into a circular arc at a tip end thereof.

9. The coin payout device as claimed in claim 6, wherein the coin support means is pivotably supported on a sidewall of the coin tube at a position deviated from center of the coin tube with respect to the coin payout direction.

* * * * *